US005250315A

United States Patent [19]

Loew et al.

[11] Patent Number: 5,250,315

[45] Date of Patent: Oct. 5, 1993

[54] METHOD FOR COOLING A BEVERAGE

[75] Inventors: Jonathon Loew, East Meadow; Michael D. Hanauer, Merrick, both of N.Y.

[73] Assignee: Design Display Group Inc., Carlstadt, N.J.

[21] Appl. No.: 933,996

[22] Filed: Aug. 21, 1992

Related U.S. Application Data

[63] Continuation of Ser. No. 628,856, Dec. 14, 1990, abandoned.

[51] Int. Cl.[5] ..... F25C 1/00

[52] U.S. Cl. ..... 426/524; 62/1; 426/515

[58] Field of Search ..... 426/524, 515, 66, 100; 62/1, 66

[56] References Cited

U.S. PATENT DOCUMENTS

| | | | |
|---|---|---|---|
| 1,476,910 | 12/1923 | Naugle | 249/122 |
| 1,592,066 | 7/1926 | Barnes | 249/120 |
| 1,688,888 | 10/1928 | Spreen | 249/120 |
| 1,753,940 | 4/1930 | Reed | 249/122 |
| 1,896,849 | 2/1933 | Newman | 249/120 |
| 1,900,290 | 3/1933 | Kudo | 249/122 |
| 2,097,356 | 10/1937 | Truesdale | 249/122 |
| 2,166,560 | 7/1939 | Schmelzer | 249/120 |
| 2,505,947 | 5/1950 | Brocke | 426/515 |
| 2,558,984 | 7/1951 | Roethel | 249/120 |
| 2,594,127 | 4/1952 | Collier | 249/120 |
| 4,091,632 | 5/1978 | Marchewka et al. | 62/1 |

*Primary Examiner*—George Yeung
*Attorney, Agent, or Firm*—Steinberg & Raskin

[57] ABSTRACT

A mold for making shot-sized drinking glasses formed of ice having a substantially cylindrical outer wall having an upper end situated in an upper horizontal plane and a lower end situated in a horizontal lower plane, and a downwardly-opening cup-shaped inner wall comprising an inner side wall portion and an inner top wall portion, the latter being situated below the upper plane in which the upper end of the outer wall is situated. Rack apparatus for making a plurality of shot-size drinking glasses formed of ice includes a multi-cavity grid in combination with a cooperating frame and a plurality of molds. Apparatus for facilitating the use of shot-size drinking glasses formed of ice include one or more holding members formed of flexible sheet material in combination with a caddy including a recess for positioning the holding member with respect to the glass.

16 Claims, 3 Drawing Sheets

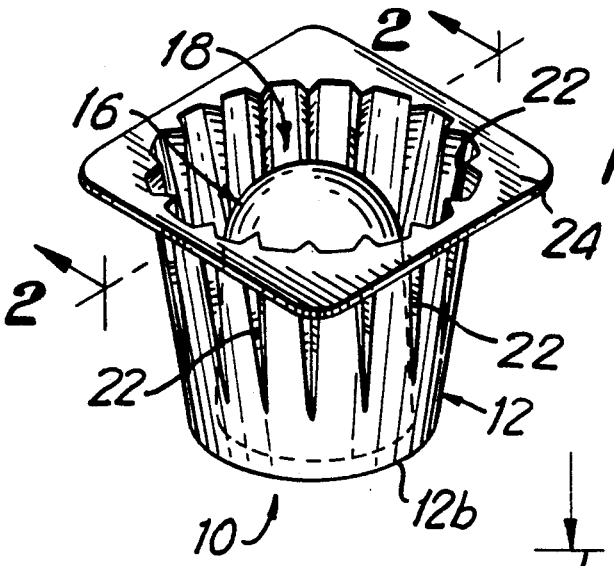
FIG. 1
FIG. 2
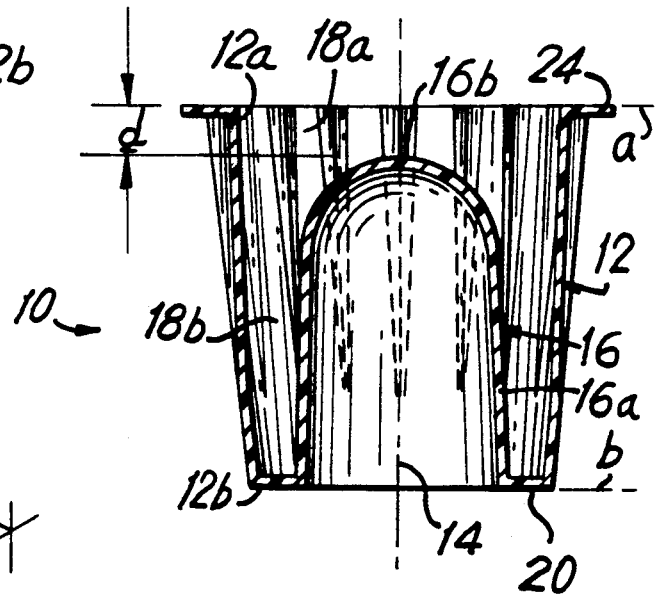
FIG. 3
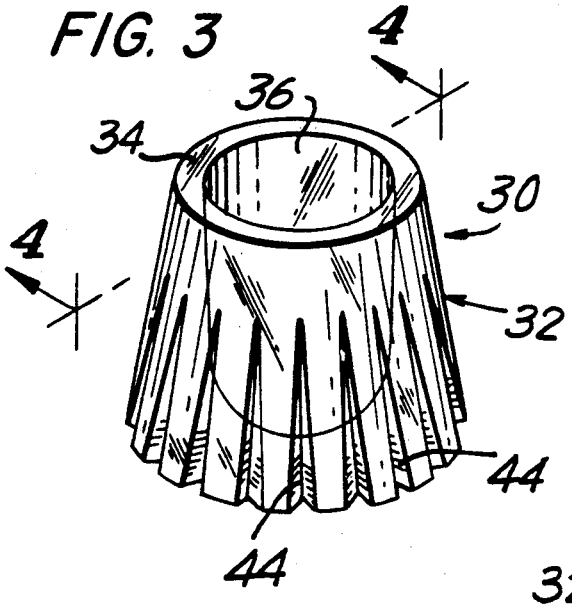
FIG. 4
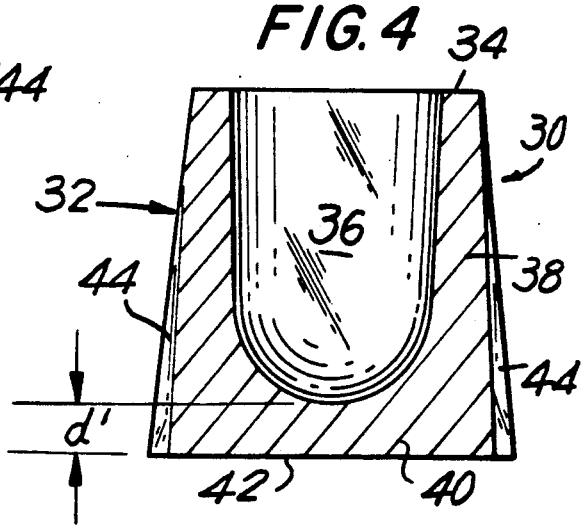

METHOD FOR COOLING A BEVERAGE

This is a continuation of application Ser. No. 07/628,856, filed Dec. 14, 1990, now abandoned.

BACKGROUND OF THE INVENTION

This invention relates generally to mold apparatus and, more particularly, to mold apparatus for making drinking glasses formed of ice, and to apparatus for using the same.

The practice of adding ice to beverages to cool the beverage to taste is obviously a widespread practice. Generally, the beverages are contained in glasses that are large enough to receive several cubes of ice of standard size. However, the use of ice cubes is clearly not practical to cool liquor served in "shot" glasses, which typically have a capacity of from 1 to 1½ ounces. On the other hand, pre-chilling conventional "shot" glasses is generally ineffective since their relatively small size prevents any significant chilling effect on liquor which is poured into them.

SUMMARY OF THE INVENTION

It is an object of the present invention to provide new and improved molds for making shot-size drinking glasses formed of ice which will have a significant chilling effect on liquor served at room temperature throughout the consumption of the drink.

Another object of the present invention is to provide new and improved molds for making shot-size drinking glasses formed of ice in a simple manner.

Still another object of the present invention is to provide new and improved mold apparatus for making a plurality of shot-size drinking glasses formed of ice.

Yet another object of the present invention is to provide new and improved apparatus for facilitating the use of shot-size drinking glasses formed of ice.

Briefly, these and other objects are obtained by providing a mold for making a shot-size drinking glass comprising an outer wall, which may be substantially cylindrical, having an upper end situated in a substantially horizontal upper plane and lower end situated in a substantially horizontal lower plane, and a downwardly-opening cup-shaped inner wall substantially co-axial with the outer wall comprising an inner side wall portion and an inner top wall portion, the latter being situated below the upper plane in which the upper end of the outer wall is situated.

According to another aspect of the invention, rack apparatus are provided for making a plurality of shot-size drinking glasses formed of ice, comprising a multi-cavity grid in combination with a cooperating frame and a plurality of molds of the type described above. The molds are provided with positioning means by which each is suspended in a respective cavity of the rack with respect to the remaining molds.

In accordance with still another aspect of the invention, apparatus for facilitating the use of the shot-size drinking glasses formed of ice are provided, comprising one or more holding members formed of flexible sheet material in combination with a caddy that includes means for positioning a holding member with a central portion thereof located over an open recess. When a holding member is so positioned, a glass made of ice is placed on its central portion, whereupon the central portion is urged into the recess causing the peripheral region of the holding member to fold upwardly towards the outer sides of the glass. The ice glass may then be filled, whereupon the user grasps the glass through the cup-shaped flexible holding member and lifts the glass to drink the beverage.

DESCRIPTION OF THE DRAWINGS

A more complete appreciation of the present invention and many of the attendant advantages thereof will be readily understood by reference to the following detailed description when considered in connection with the accompanying drawings in which:

FIG. 1 is a perspective view of a mold in accordance with the invention for making a shot-size glass formed of ice;

FIG. 2 is a section view of a mold taken along line 2—2 of FIG. 1;

FIG. 3 is a perspective view of a shot-size ice glass made in a mold of the type shown in FIGS. 1 and 2;

FIG. 4 is a section view of the ice glass taken along line 4—4 of FIG. 3;

DESCRIPTION OF THE PREFERRED EMBODIMENTS

Figures 5, 6:
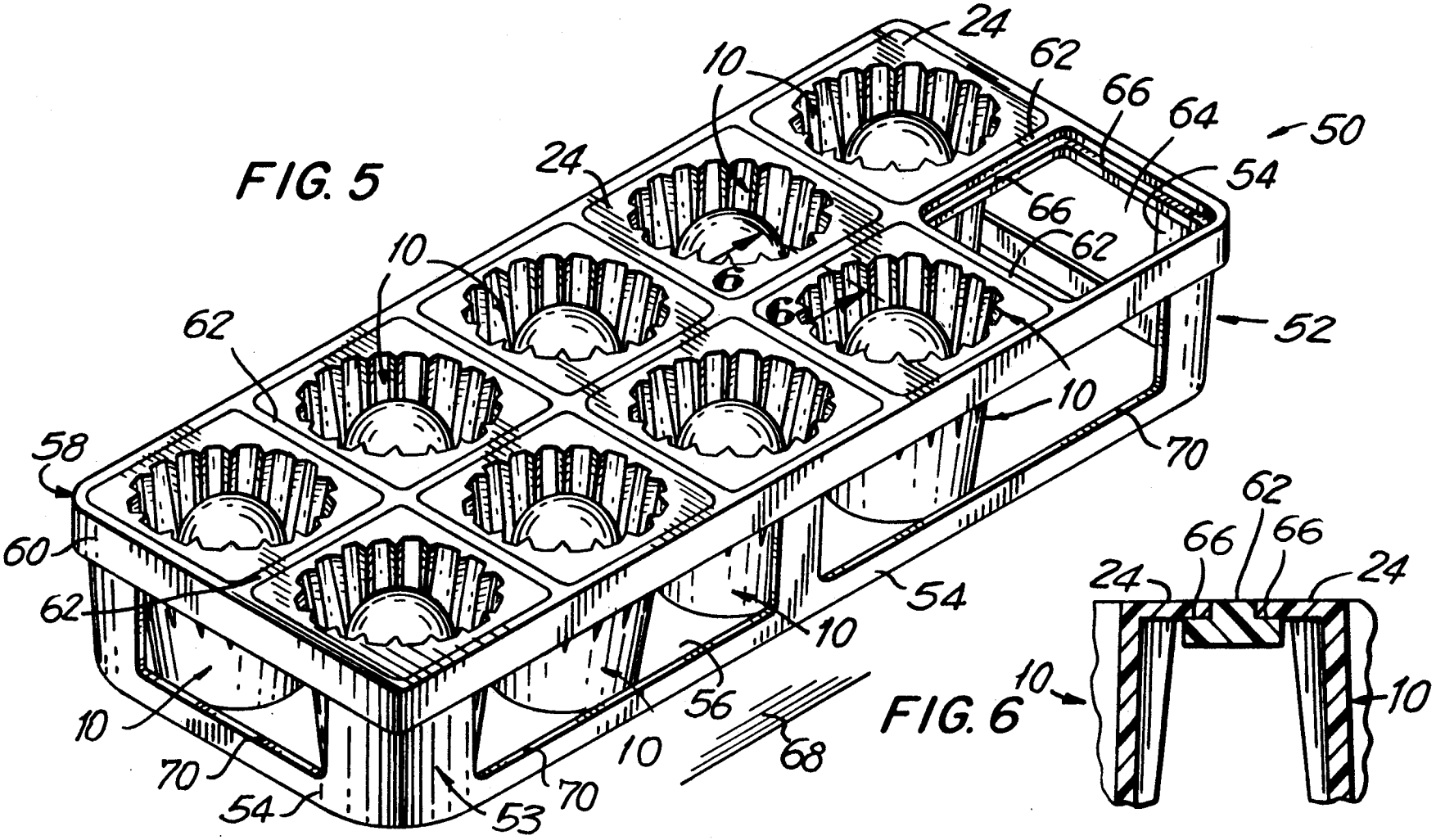
FIG. 5 is a perspective view of mold apparatus for making a plurality of shot-size glasses formed of ice.
FIG. 6 is a partial section view of the mold apparatus taken along line 6—6 of FIG. 5.

Referring now to the drawings where like reference characters designate identical or corresponding parts throughout the several views, and more particularly to FIGS. 1 and 2, a mold for making shot-size drinking glasses formed of ice in accordance with the invention is generally designated 10. The mold 10 itself is preferably formed of thin plastic sheet material, such as polystyrene or polyethylene, molded into the shape illustrated in FIGS. 1 and 2, such as by injection molding or other conventional technique.

Mold 10 comprises an outer wall 12 having a central vertical axis 14. Outer mold wall 12 has an upper end **12*a* which is situated in a substantially horizontal upper plane a, and a lower end 12*b* which is situated in a substantially horizontal lower plane b. The height of mold 10** is preferably in the range of between about 1.75 inches to 3 inches.

A downwardly-opening, cup-shaped inner wall 16 of mold 10 integral and substantially co-axial with the outer wall 12 includes an inner side wall portion **16*a* which is connected at its lower end to the lower end 12*b* of outer wall 12, and an inner top wall portion 16*b*. The uppermost part of inner top wall portion 16*b* is situated a distance d below the upper plane a in which the upper end 12*a* of the outer wall 12** is situated. Distance d is preferably in the range of between about 0.125 inches to 0.750 inches.

A mold cavity 18 defined by the outer and inner walls 12 and 16 has an inverted cup-shaped configuration comprising an upper disc-shaped portion **18*a* bounded by the region of outer wall 12 situated above the plane containing the uppermost part of the inner top wall portion 16*b* of inner wall 16, and a lower cylinder-shaped portion 18*b* bounded by the lower region of outer wall 12 situated below the plane containing the top wall portion 16*b* of inner wall 16, and the side wall portion of 16*a* of inner wall 16. As best seen in FIG. 2, in the illustrated embodiment, the radial thickness of the lower cylinder-shaped portion 18***b* of the mold cavity between outer and inner walls 12 and 16 decreases in the downward direction. Outer wall 12 has a substantially frusto-conical shape that tapers in the downward direction to converge towards the lower region of the side wall portion 16*b* of inner wall 16, which preferably has a substantially frusto-conical shape that slightly tapers in the upward direction. An annular-shaped bottom wall 20 of small radial dimension interconnects the lower end of the side wall 16*a* of inner wall 16 with the lower end 12*b* of outer wall 12.

A plurality of inwardly protruding ribs 22 are formed by the outer wall 12 which are spaced around its circumference, and communicate with the mold cavity 18. Each rib 22 extends in the direction of an element of the generatrix of the frusto-conical outer wall 12, from its upper end 12*a* to a point spaced from the lower end 12*b*.

A square-shaped lip or flange 24 extends outwardly from the upper end 12*a* of outer wall 12 in the horizontal upper plane a. Flange 24 functions to stiffen the outer wall 12 and, according to another aspect of the invention described below, locate the mold in a certain position with respect to other similar molds in a multi-cavity rack in connection with the production of a plurality of shot-size drinking glasses formed of ice.

In using mold 10 to make a glass formed of ice, the mold cavity 18 is filled with water, preferably substantially to the level of the plane a of the upper end 12*a* of outer wall 12, or at least to a height somewhat above the uppermost part of the top wall portion 16*b* of inner wall 16. The mold filled with water is placed in a freezer whereupon the water in the cavity is eventually frozen solid. When it is desired to use the glass, the mold is removed from the freezer and inverted whereupon a glass formed by the ice is removed from the mold cavity 18. The downwardly widening dimensions of the cylindrical-shaped portion 18*b* of mold cavity 18 (when mold 18 is inverted) facilitates removal of the ice glass from the mold cavity. However, it is understood that this feature is not critical so long as no undercuts are present in the mold when it is inverted.

A shot-size ice glass 30 in accordance with the invention made from a mold of the type shown in FIGS. 1 and 2 is illustrated in FIGS. 3 and 4. The glass 30 comprises a downwardly widening, substantially cylindrical, frusto-conical body 32, having the shape of the outer wall 12 of the mold, onto the top 34 of which opens a downwardly narrowing beverage-receiving cavity 36. The cavity 36, having the shape of the inner wall 16 of the mold, has a volume sufficient to hold a "shot-size" portion of beverage, i.e. about 1 to 1½ ounces. The body 32 defines a downwardly widening side wall 38 and a bottom wall 40 having a thickness d' (FIG. 4) and a flat bottom surface 42. The downwardly-widening shape of wall 38 is advantageous since beverage will generally be present for a longer period of time in the bottom region of the cavity 36 so that the thickness of the portion of wall 38 surrounding that bottom region should be greater to provide a greater cooling capacity. The thickness d' of the bottom wall 40 is substantially equal to the distance d (FIG. 2) that the inner top wall portion 16*b* of mold 10 is situated below the plane of the upper end 12*a* of the outer mold wall 12, assuming that the mold has been filled to its upper level. A plurality of channels 44, formed by the mold ribs 22, are formed within the outer surface of the wall 38. These ridges enable the user to grasp the glass more securely keeping in mind that the glass becomes very slippery as the ice begins to melt and a film of water forms on its outer surface.

Although the body 32 of the glass 30 shown in the illustrated embodiment is substantially cylindrical in shape due to the corresponding shape of the outer wall 12 of mold 10, it is understood that the body of the glass may have any desired shape within the scope of the invention. For example, the glass body may have a square cross-section, or some cross-section other than round, depending upon the shape of the outer wall of the mold.

Referring to FIGS. 5 and 6, mold apparatus, generally designated 50, is illustrated for making a plurality of shot-size drinking glasses formed of ice. Mold apparatus 50 comprises a rack 52 and a plurality of ice glass molds 10 of the type shown in FIGS. 1 and 2 suspended therein. In particular, the rack 52 comprises a rectangular frame 53 defined by four substantially vertical side walls 54 (only three shown) defining an open bottom 56. A grid 58 situated over the open top of frame 53 comprises a rectangular flange 60 extending around the upper periphery of frame 53 and longitudinal and transverse ribs 62 defining, together with flange 60, a plurality of equally sized adjacent square openings or cavities 64. In the illustrated embodiment, the grid 58 includes ten such cavities 64 arranged in two rows of five each, although the number and arrangement is not critical. An upwardly facing shoulder 66 formed on ribs 62 and flange 60, recessed below the top surfaces thereof, extends around the square periphery of each of the cavities 64 of grid 58.

As noted above, the flange 24 of ice mold 10 has a square outer periphery and, according to this aspect of the invention, each mold flange 24 is shaped to fit snugly within a respective one of the square cavities 64 so that its outer edge region is supported on the shoulder 66 of the cavity over its entire peripheral extent. Each of the ice molds 10 can then be suspended in a respective cavity 64 through the engagement of the shoulder 66 with the underside of the peripheral edge of the respective mold flange 24. The vertical distance between a counter or shelf surface 68, on which the frame 53 of rack 52 is situated as shown in FIG. 5, and the plane of shoulder 66 is greater than the height of each of the ice molds 10, so that when the molds 10 are positioned in respective cavities 64, the rack may be placed on the counter or shelf with the individual molds being suspended by their respective flanges. The molds may then be filled with water and the assembly placed in a freezer. After the water has frozen and it is desired to use one of the ice glasses, a single one of the molds is simply withdrawn from its cavity in the rack grid. Openings 70 are provided in side walls 54 of frame 53 to facilitate handling. This aspect of the invention is advantageous in that it facilitates the handling, filling and use of the ice molds, and also improves the stability of the filled molds by supporting them on the four peripheral regions of each of the flanges.

Figure 7:
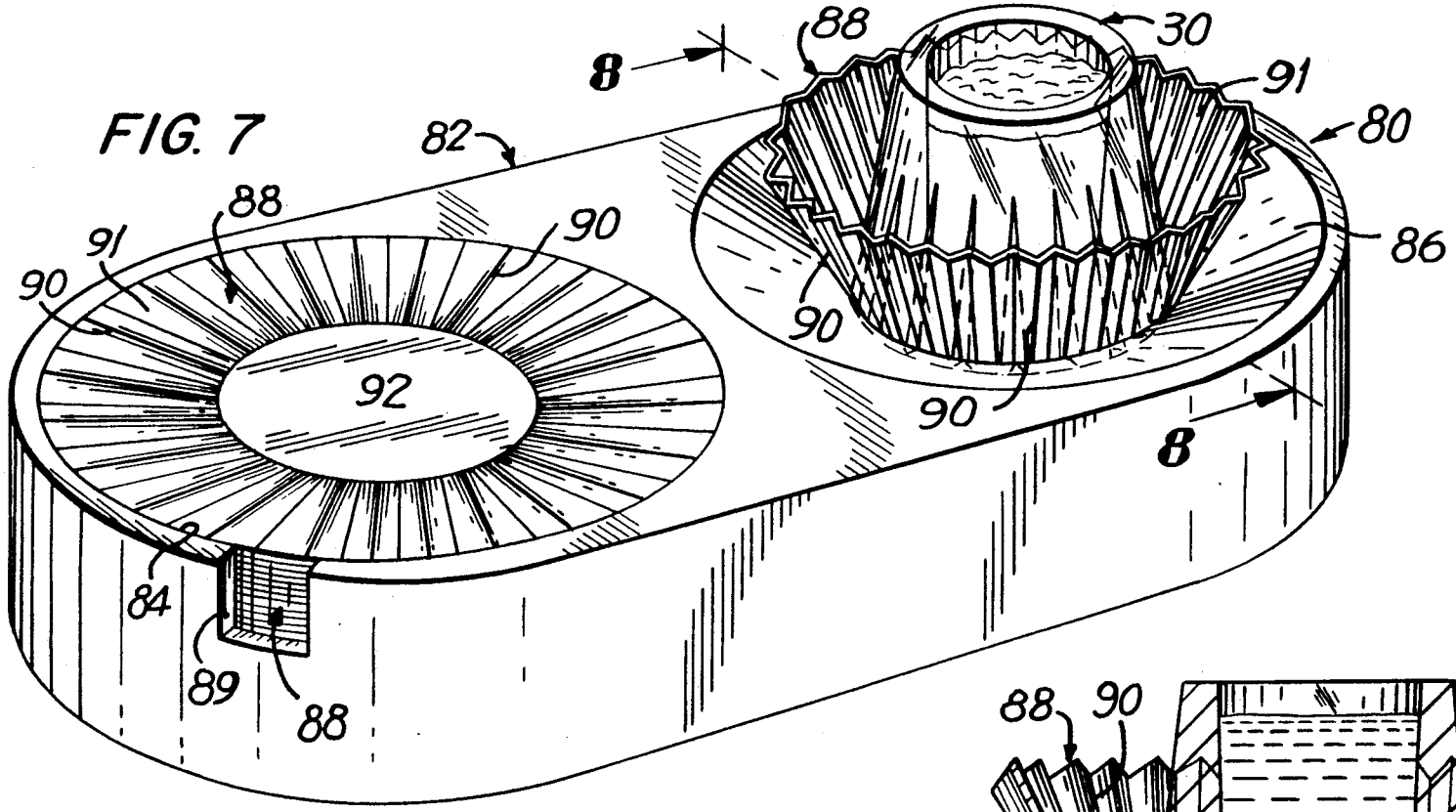
FIG. 7 is a perspective view of apparatus for facilitating the us of shot-size ice glasses.
Figure 8:
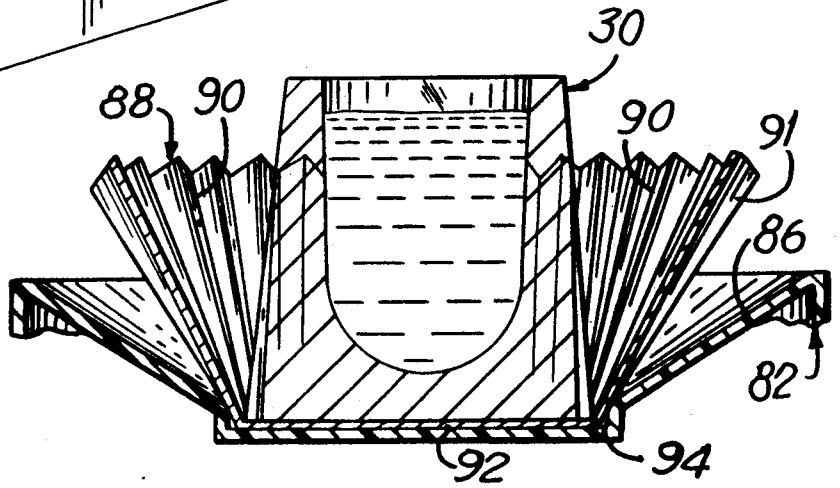
FIG. 8 is a partial section view of the apparatus shown in FIG. 7 taken along line 8—8 of FIG. 7.

According to another aspect of the invention, apparatus generally designated 80, are illustrated in FIGS. 7 and 8 for facilitating the use of shot-size drinking glasses 10 formed of ice of the type shown in FIGS. 3 and 4. Apparatus 80 include a caddy 82 having first and second circular recesses 84 and 86 formed therein. A plurality of coaster-like holding members 88 formed of circular sheets of flexible material are stacked and maintained in the first recess 84 A thumb notch 89 is formed in the side of caddy 82 to facilitate grasping the top one of the holding members and removing it from the stack. Each holding member 88 may comprise a circular sheet of paper or paper like material, and has a plurality of radial pleats 90 extending over an annular peripheral region 91 between the outer circumference of a central unpleated region 92, and the outer edge of the holding member. The second recess 86 formed in the caddy 82 receives, and thereby positions, a holding member 88 so that its central unpleated region 92 is positioned over a shallow smaller diameter cylindrical recess or cavity 94 centrally formed in the bottom of the second recess 86, the diameter of recess 94 being slightly larger than the diameter of the bottom of the ice glass 30.

In use, after an ice glass 30 has been removed from a mold 10, a flexible holding member 88 is removed from the top of the supply stack in first cavity 84 and transferred into the second recess 86. The ice glass 30 is then placed on the central unpleated region 92 of the flexible holding member whereupon its lower end region is received in the shallow cavity 94 as best seen in FIG. 8. This in turn causes the annular pleated region 91 of holding member 88 to fold upwardly towards the outer wall of ice glass 30 into a cup-shaped configuration as seen in FIGS. 7 and 8. The ice glass is then filled whereupon the user grasps the glass through the cup-shaped flexible holding member 88 and lifts the glass 30 to his mouth partially supported by the central region 92 of holding member 88. This provides the dual benefit of preventing the ice glass from slipping from the user's grasp, and thermally insulating the user's hand from the cold ice forming the glass.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A method for cooling a beverage prior to consumption, comprising the steps of:

providing a mold for making a drinking glass formed of a frozen liquid, said mold having an outer wall having a central vertical axis, said outer wall having an upper end situated in a substantially horizontal upper plane, and a lower end situated in a substantially horizontal lower plane;

a downwardly-opening cup-shaped inner wall substantially coaxial with said outer wall comprising an inner side wall portion and an inner top wall portion, said inner top wall portion being situated below said upper plane in which said upper end of said outer wall is situated, said inner side wall portion being connected at a lower end thereof to said lower end of said outer wall; and said outer and inner walls defining a mold cavity between them;

filling said mold cavity with a liquid to a height above an uppermost part of said inner top wall portion;

cooling said liquid until it freezes within said mold cavity to form a glass having a beverage-receiving cavity;

removing said glass formed of frozen liquid from said mold cavity; and pouring beverage to be consumed into said beverage-receiving cavity of said frozen liquid glass, whereby said beverage is cooled through contact with the frozen liquid of which said glass is formed.

2. The method of claim 1 wherein said mold cavity defined between said outer and inner walls tapers in a downward direction.

3. The method of claim 1 wherein said mold further includes a bottom wall interconnecting said lower end of said side wall portion of said inner wall and said lower end of said outer wall.

4. The method of claim 1 wherein said mold further comprises a planar flange extending outwardly from said upper end of said outer wall in a substantially horizontal plane.

5. The method of claim 1 wherein said outer wall has a plurality of ribs formed therein.

6. The method of claim 1 wherein said inner side wall portion of said inner wall tapers in an upward direction.

7. The method of claim 1 wherein said mold is formed of thin plastic sheet material.

8. The method of claim 1 wherein said liquid with which said mold cavity is filled is water.

9. The method of claim 1 wherein said glass is a shot-size glass.

10. A method for cooling a beverage prior to consumption, comprising the steps of:

providing mold apparatus for making a plurality of drinking glasses formed of a frozen liquid, said apparatus comprising a rack including a plurality of cavities in which a plurality of molds can be suspended; and a plurality of molds for forming drinking glasses removably receivable in said cavities of said rack, each mold comprising an outer wall having a central vertical axis, said outer wall having an upper end situated in a substantially horizontal upper plane and a lower end situated in a substantially horizontal lower plane, a downwardly-opening cup-shaped inner wall substantially coaxial with said outer wall comprising an inner side wall portion and an inner top wall portion, said outer and inner walls defining a mold cavity between them, and positioning means extending outwardly from said upper end of said outer wall for locating each mold in a respective cavity with respect to said other molds;

suspending each mold in a respective cavity with respect to said other molds;

filling the mold cavity of each of said molds with a liquid to a height above an uppermost part of said inner top wall portion;

cooling said liquid until it freezes within the mold cavity of each of said molds to form a glass having a beverage-receiving cavity;

removing at least one of said molds from its respective cavity in said rack;

removing said glass formed of frozen liquid from the mold cavity of said removed mold;

pouring beverage to be consumed into said beverage-receiving cavity of said removed frozen liquid glass;

whereby said beverage is cooled through contact with the frozen liquid of which said glass is formed.

11. The method of claim 10 wherein said positioning means comprise a substantially planar flange extending outwardly from said upper end of said outer wall of each of said molds.

12. The method of claim 11 wherein said flange has a substantially square peripheral edge.

13. The method of claim 10 wherein said rack comprises a grid having ribs defining a plurality of cavities, each of said cavities shaped to receive a corresponding mold.

14. The method of claim 11 wherein each of said cavities includes an upwardly facing peripheral shoulder formed on said ribs, said flange of each said mold having an outer peripheral edge region shaped to be supported by said shoulder of a respective cavity.

15. The method of claim 10 wherein said outer wall of each of said molds tapers in a downward direction.

16. The method of claim 10 wherein said molds are formed of thin plastic sheet material.

* * * * *